US010737751B2

(12) United States Patent
Dobbins

(10) Patent No.: US 10,737,751 B2
(45) Date of Patent: Aug. 11, 2020

(54) HANDLE ATTACHMENT AND HYBRID PADDLE

(71) Applicant: Brian Dobbins, La Mesa, CA (US)

(72) Inventor: Brian Dobbins, La Mesa, CA (US)

( * ) Notice: Subject to any disclaimer, the term of this patent is extended or adjusted under 35 U.S.C. 154(b) by 25 days.

(21) Appl. No.: 15/985,613

(22) Filed: May 21, 2018

(65) Prior Publication Data

US 2019/0351987 A1 Nov. 21, 2019

(51) Int. Cl.
*B63H 16/04* (2006.01)
*A63B 35/06* (2006.01)

(52) U.S. Cl.
CPC ..... *B63H 16/04* (2013.01); *A63B 35/06* (2013.01)

(58) Field of Classification Search
CPC ..... B63H 16/04; A63B 35/06
See application file for complete search history.

(56) References Cited

U.S. PATENT DOCUMENTS 8,632,371 B1 1/2014 Ramsey
8,974,141 B2 3/2015 Williford
9,586,662 B2 3/2017 Cyr
2013/0045099 A1* 2/2013 Bicknell ..... B25G 1/06 416/1
2013/0122761 A1* 5/2013 Macias ..... B63B 35/7933 441/74
2013/0230398 A1* 9/2013 Hall ..... B63H 16/04 416/1
2016/0228759 A1* 8/2016 Henrie ..... A63C 11/227
2018/0050778 A1* 2/2018 Jones ..... B63H 16/04

* cited by examiner

*Primary Examiner* — Stephen P Avila
(74) *Attorney, Agent, or Firm* — TJSL Patent Clinic

(57) ABSTRACT

A hybrid paddle for use in both a standing and a kneeling position is disclosed. The paddle has a shaft terminating in a blade at each end. At or near each throat or junction between the shaft and a blade is a handle. The handle has a grip sufficiently offset from the blade to allow a user to grip the handle without his or her hand colliding with the blade. While kneeling, the user grips the shaft with both hands, and alternates the placement of the blades in the water. While standing, the user grasps the handle with one hand and the shaft with the other hand, and a single blade is placed in the water. In this way, the same paddle is used in both the standing and kneeling positions, and the user can alternate between standing and kneeling as desired.

17 Claims, 15 Drawing Sheets

HANDLE ATTACHMENT AND HYBRID PADDLE

FIELD OF THE DISCLOSURE

The present application relates to paddles, and more specifically to a handle and grip attached to a paddle to allow a single paddle to be used in standing, sitting, and kneeling positions.

BACKGROUND

Among popular pastimes at the beach are paddleboarding and kayaking. Paddleboarding involves the use of a paddle to propel oneself while kneeling or standing on a surfboard-like apparatus known as a paddleboard. Kayaking also uses a paddle for propulsion of a kayak and its occupant or occupants.

A paddle is generally comprised of a shaft with a blade on at least one end. The specific makeup of a paddle varies with the type of watercraft. For example, a paddle for a paddleboard has a shaft with a single blade on one end, and a grip on the other. It is used with one hand on the grip and the other hand on the shaft, with the blade in the water to provide propulsion. A paddle for kayaking has a blade on each end of the shaft, with one blade at a time in the water to provide propulsion.

SUMMARY

Disclosed is a handle attachment for a paddle, comprising a handle comprising a grip and a mounting structure configured to removably attach the handle to the paddle. In an exemplary embodiment, the handle is configured so that the grip is offset from the paddle when the handle is attached to the paddle, the offset being sufficient to avoid collision of a hand grasping the grip with the paddle. In an exemplary embodiment, the mounting structure comprises a cylindrical aperture sized to fit around a throat of the paddle. In an exemplary embodiment the mounting structure further comprises a hinge configured to allow the mounting structure to be placed in an open configuration for removal from the paddle, and a closed configuration for attachment to the paddle. In an exemplary embodiment the handle attachment for a paddle as recited in claim 4, wherein the mounting structure further comprises a locking member configured to secure the mounting structure in the closed configuration.

In some embodiments the mounting structure comprises fasteners configured to secure the handle to the paddle. In some embodiments the mounting structure also comprises a handle mount secured to the paddle. In some embodiments the handle mount comprises a receptor and the handle comprises one or more locking posts configured to be received by the receptor.

Also disclosed is a hybrid paddle, comprising a shaft between a first end and a second end. A first blade is at the first end, and a first throat comprises a first junction between the first blade and the shaft. There is a first handle at the first throat. A second blade is at the second end, and a second throat comprises a second junction between the second blade and the shaft. As with the first throat, there is a second handle at the second throat.

In some embodiments, the first handle comprises a first grip configured for use in stand-up paddleboarding, and the second handle comprises a second grip configured for use in stand-up paddleboarding. In an exemplary embodiment the first grip is sufficiently offset from the first blade so that a user may grip the first handle without colliding with the first blade.

In some embodiments the shaft has a predetermined length configured to facilitate use of the hybrid paddle in kayaking. Some embodiments also comprise means for adjusting a length of the hybrid paddle. In an exemplary embodiment the means for adjusting length of the hybrid paddle comprises a first blade pin hole at the base of the first blade, at least two first end pin holes at the first end of the shaft, and a pin configured to pass through the first blade pin hole and one of the at least two first end pin holes in order to secure the first blade to the shaft.

In some embodiments the first handle is integral with the first blade, and the second handle is integral with the second blade.

In exemplary embodiments the first blade is topologically simply connected, and the second blade is topologically simply connected.

Also disclosed is a hybrid paddle; the paddle comprises a shaft between a first end and a second end. There is a first blade at the first end and a first throat comprising a first junction between the first blade and the shaft. There is also a second blade at the second end and a second throat comprising a second junction between the second blade and the shaft. A first handle comprising a first grip is configured to removably attach to the paddle at the first throat, and a second handle comprising a second grip is configured to removably attach to the paddle at the second throat.

In exemplary embodiments the first handle is configured so that the first grip of the first handle is offset from the paddle when the first handle is attached to the paddle, the offset being sufficient to avoid collision of a hand grasping the grip of the first handle with the paddle. In such embodiments the second handle is also configured so that the second grip of the second handle is second offset from the paddle when the second handle is attached to the paddle, the second offset being sufficient to avoid collision of a hand grasping the second grip of the second handle with the paddle.

In some embodiments the first handle and the second handle each comprise a mounting structure. The mounting structure has a cylindrical aperture sized to fit around a throat of the paddle and a hinge configured to allow the mounting structure to be placed in an open configuration for removal from the paddle, and a closed configuration for attachment to the paddle.

In some embodiments the first handle and the second handle each comprise a mounting structure comprising fasteners configured to secure the first handle or the second handle to the paddle, a handle mount secured to the paddle, and a receptor. The first handle comprises one or more first locking posts configured to be received by the receptor of the mounting structure of the first handle. The second handle comprises one or more second locking posts configured to be received by the receptor of the mounting structure of the second handle.

BRIEF DESCRIPTION OF THE DRAWINGS

The novel features of this invention, as well as the invention itself, both as to its structure and its operation, will be best understood from the accompanying drawings, taken in conjunction with the accompanying description, in which.

DETAILED DESCRIPTION

Figure 1:
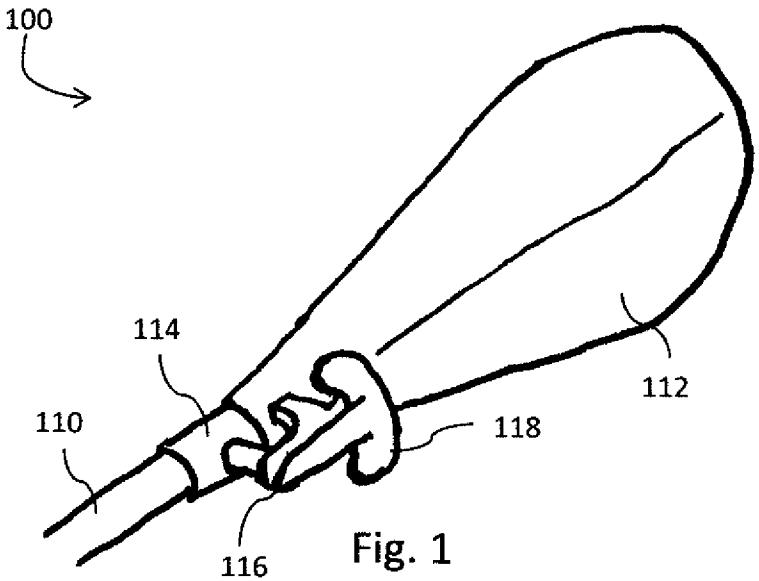
FIG. 1 illustrates a portion of a hybrid paddle, showing a paddle blade attached to an end of a shaft.

Referring initially to FIG. 1, a portion of a hybrid paddle 100 is depicted. Paddle 100 comprises a shaft 110 terminating in a blade 112 at each end. The area around which the shaft 110 is joined to a blade 112 (or, in some paddles, tapers into a blade) is known as a "throat" 114. On or near at least one throat 114 of the paddle 100 is a handle 116 comprising a grip 118 that allows a user to use the paddle 100 as a stand-up paddleboarding paddle. Preferred embodiments of the paddle 100 include two (2) handles 116, one at each throat 114, which allows the user to grip the paddle 100 from either side. Due to the presence of two blades 112, one at each end of the paddle 100, the paddle 100 is also usable as a paddle for a kayak, canoe, or other watercraft requiring a double-bladed paddle.

A particular feature of the blade 112 and other paddle blades described herein is that the blade 112 is topologically simply connected, meaning that the blade 112 has a continuous surface with no openings through the blade 112. Thus an object, such as a hand, finger, or even water will not be able to pass through the blade 112, maximizing the resisting force, and thus the propulsion, that it provides as it passes through water. It will also be clear to one of skill in the art that the hybrid paddle could be made with other blades not having this feature in circumstances in which the related benefit is not desired.

Figure 2:
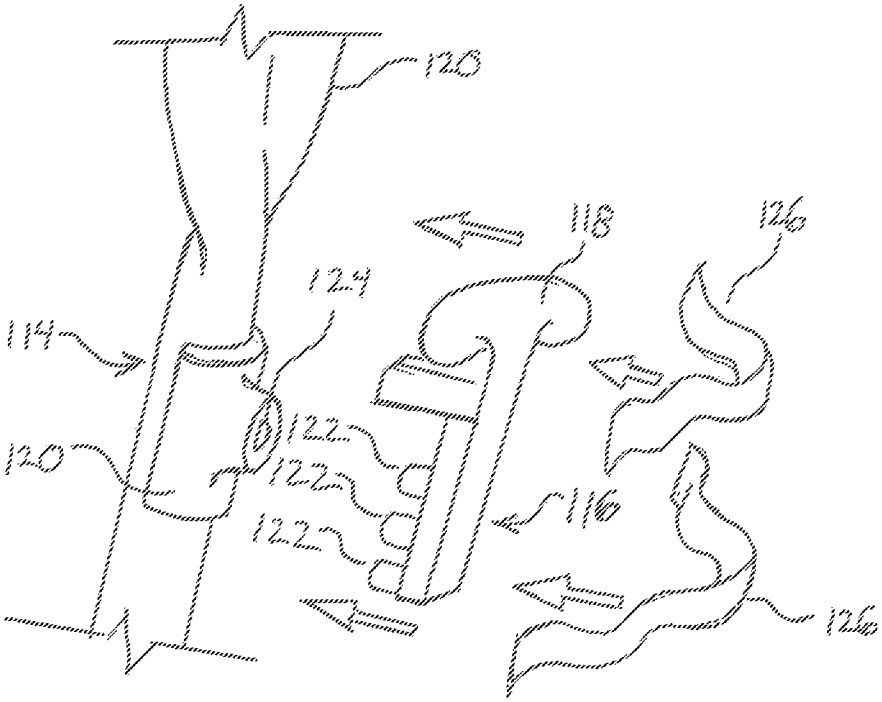
FIG. 2 illustrates a handle being mounted onto a paddle.

Referring now to FIG. 2, the mounting of a handle 116 onto a paddle 100 is shown. A handle mount 120 secured to the paddle 100 at the throat 114 ensures that the handle 116, once mounted, does not move or rotate around the paddle 100. In exemplary embodiments, the handle mount 120 is integral with the paddle 100, forming a seamless portion of the shaft 110 and throat 114. In an alternative embodiment, the handle mount 120 comprises a polyvinyl chloride (PVC) tee (e.g., a T-shaped junction for PVC pipe, commonly sold in hardware stores) cut across opposite openings in order to fit against the shaft 110, or a snap tee or a saddle tee (e.g., PVC tees in which the base comprises an arc-shaped cross section rather than a completely circular cross section), which provide a similar shape for the handle mount 120. The tee is attached to the shaft 110 with an adhesive, bolts, or other form of attachment known in the art.

In preferred embodiments, the handle 116 comprises one or more locking posts 122 sized to fit in a receptor 124 on the handle mount 120. In embodiments in which the handle mount 120 comprises a PVC tee, the receptor 124 comprises the orthogonal outlet of the tee. A preferred embodiment of the handle 116 has three (3) locking posts 122, allowing the user a degree of choice in the precise position of the handle 116. Other embodiments have one (1) locking post 122, two (2) locking posts 122, or larger numbers of locking posts 122.

To mount the handle 116, the handle 116 is oriented so that the grip 118 is toward the blade 112 at the end of the paddle 100 to which the handle 116 is being mounted. The handle 116 is then placed onto the handle mount 120 so that a locking post 122 engages the receptor 124. The handle 116 is then secured to the paddle 100 with one or more fasteners 126. In preferred embodiments, two (2) fasteners 126 are used to secure the handle 116. Shown in FIG. 2 are fasteners 126 comprising strips of fabric with hook and loop fasteners such as those sold under the brand name VELCRO®. It will be apparent to one of skill in the art that fabric fasteners 126 without hook and loop fasteners may be used by tying the fasteners around the paddle 100. Moreover, other forms of fastener 126 may be used, such as bolts, locking pins, a pin or latch activated by a spring-loaded button or slide, or other fastening devices known in the art.

Figure 3:
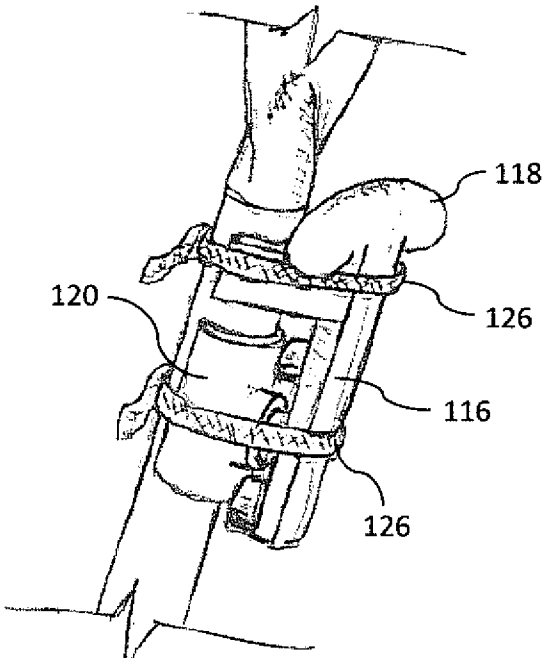
FIG. 3 illustrates a handle mounted and secured on a paddle.

Referring now to FIG. 3, a handle 116 is shown mounted to a paddle 100 at the throat 114 with fasteners 126 securing the handle 116 to the paddle 100. With the handle 116 mounted, the user may grasp the grip 118 in order to use the paddle 100 for activities such as stand-up paddleboarding which normally require a single-blade paddle.

Figure 4:
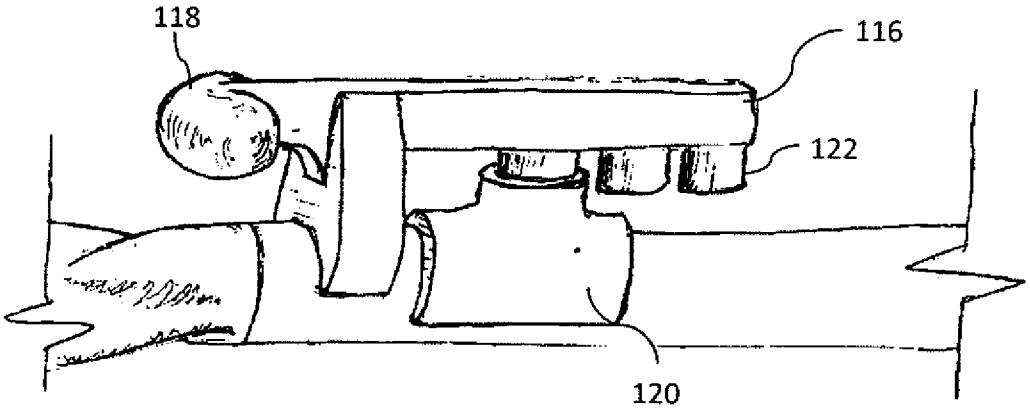
FIG. 4 illustrates a handle mounted and secured on a paddle in an alternate configuration.

Referring now to FIG. 4, it can be seen that the handle 116 may be mounted such that any of the locking posts 122 engages the receptor 124. This allows the user a degree of flexibility in positioning the handle 116. Also seen in FIG. 4 is that when the handle 116 is mounted, the grip 118 is positioned a certain distance away from the blade 112 and the throat 114 of the paddle 100. More particularly, the grip 118 of the mounted handle 116 is located sufficiently apart from the blade 112, throat 114, and shaft 110 of the paddle 100 so that the user's hand does not touch or collide with the paddle 100, including the blade 112, throat 114, or shaft 110, while grasping the grip 118.

Figure 5:
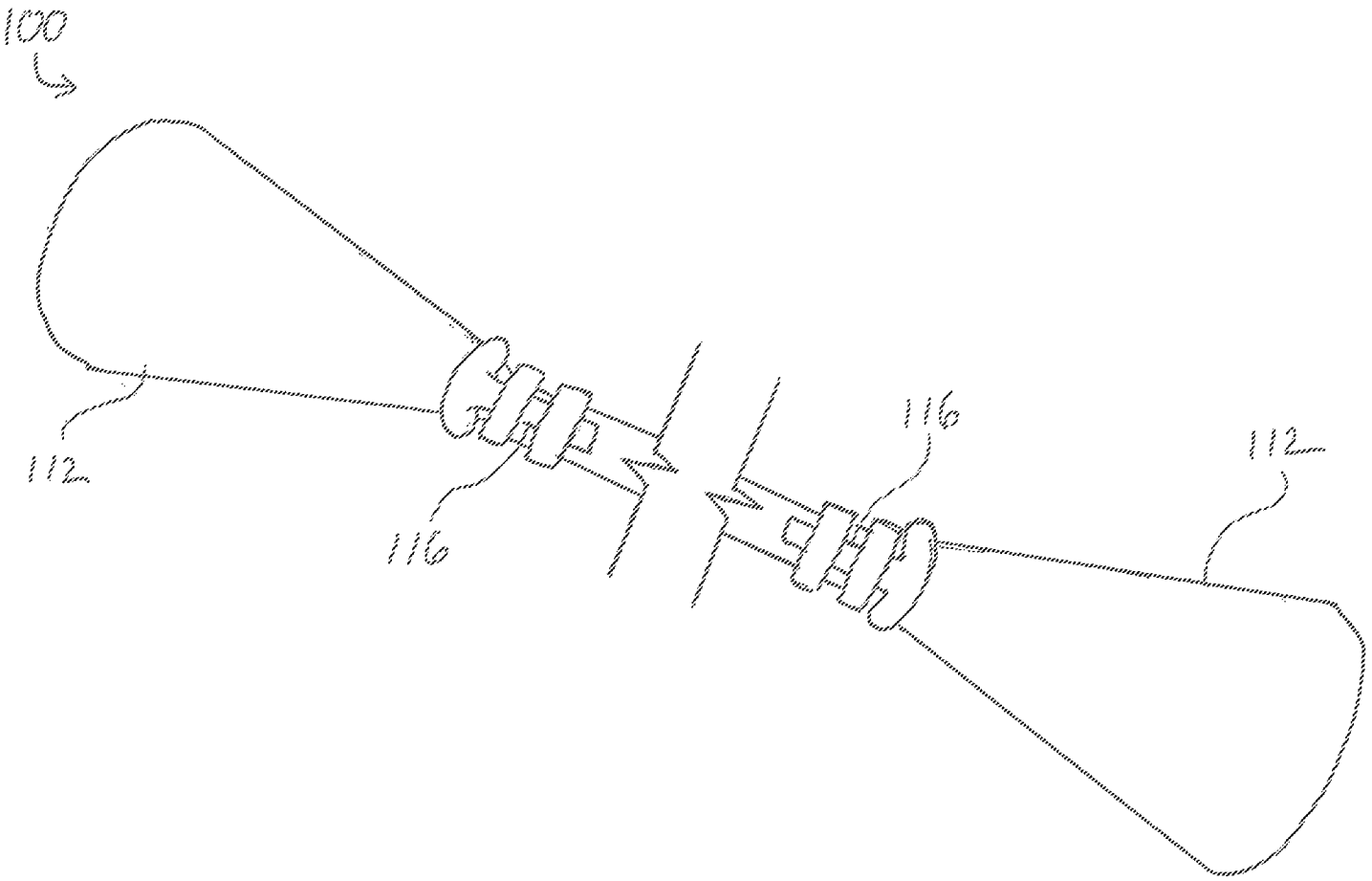
FIG. 5 illustrates a handle mounted and secured on each end of a paddle.

Referring now to FIG. 5, a paddle 100 is shown with a handle 116 attached to each blade 112. In such a configuration, a user may grasp either handle 116 in order to use the paddle 100 as if it were a single-bladed paddle.

Figure 6:
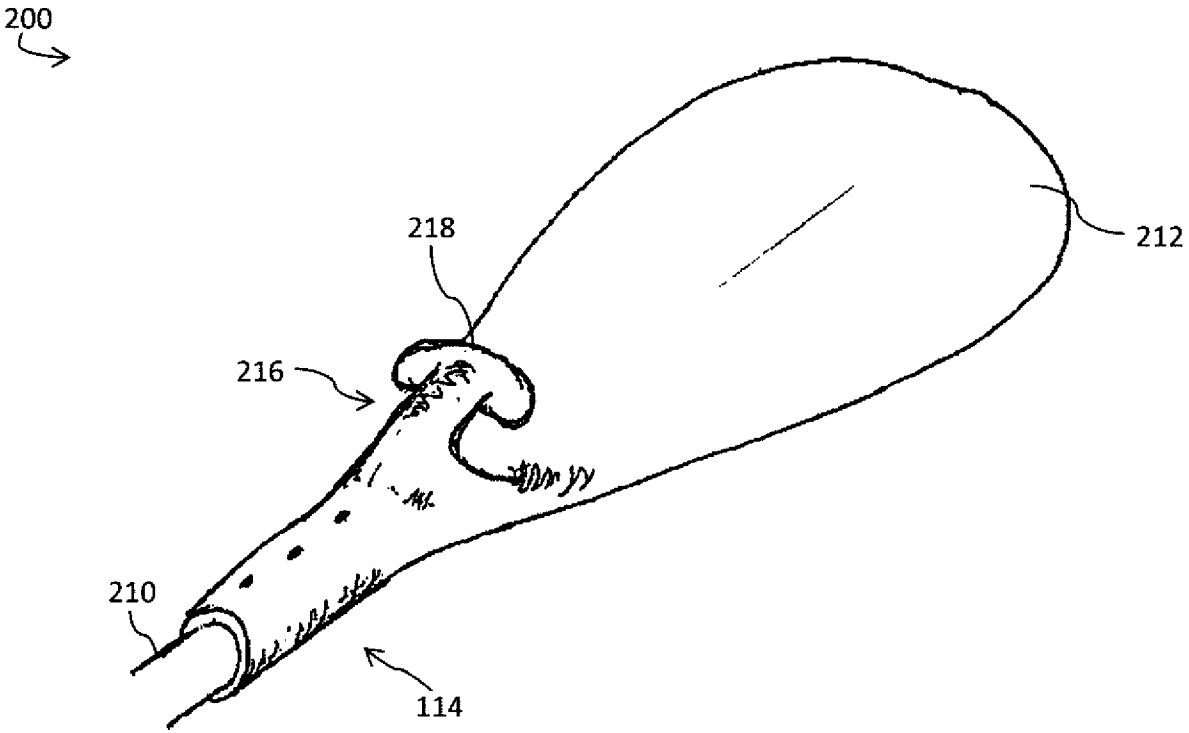
FIG. 6 illustrates an alternate embodiment of a hybrid paddle having a built-in handle.

Referring now to FIG. 6, an alternative embodiment of a hybrid paddle is shown and generally designated 200. Paddle 200 comprises a shaft 210 with a blade 212 at each end. Each blade 212 is joined to the shaft 210 at a throat 214. At or near each throat 214 is a handle 216 having a grip 218. Handle 216 is integral with the blade 212, that is, it is formed seamlessly with the blade 212 out of the same material. For example, in embodiments in which the blade 212 is made through an injection molding process, the blade 212 and handle 216 are formed together as a single part in the same mold. As with other embodiments, the grip 218 is sufficiently offset to avoid collision of the user's hand with the paddle 200, and more particularly the blade 212, while grasping the grip.

Figure 7:
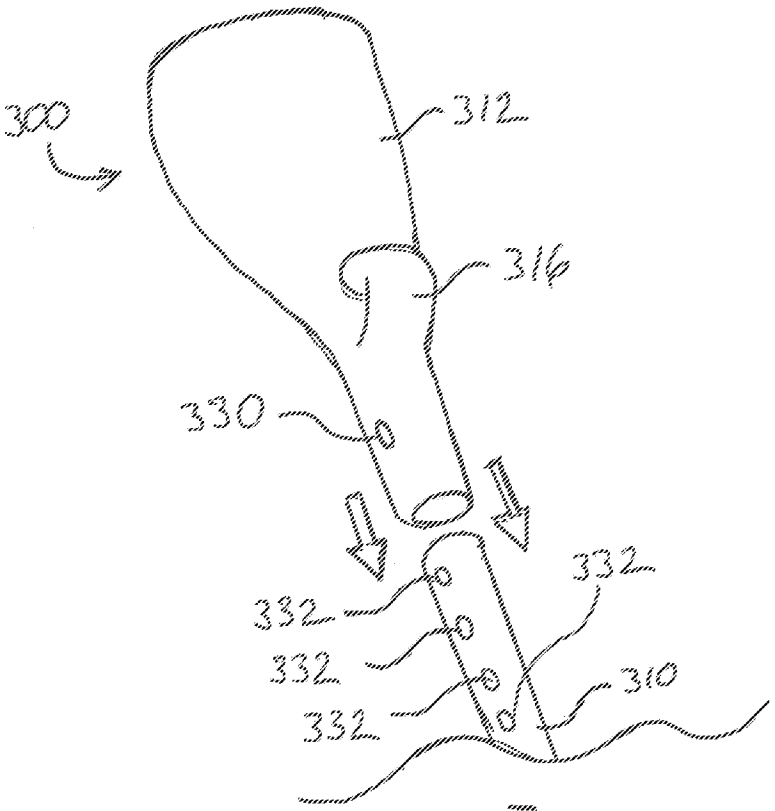
FIG. 7 illustrates a hybrid paddle having pin holes for the adjustment of the paddle length.

As seen in FIG. 7, some embodiments of a hybrid paddle comprise an adjustable length paddle 300. Although paddle 300 is depicted as having an integral handle 316, similar to the paddle 200 shown in FIG. 6, a paddle with a separately mountable handle 116, such as paddle 100 shown in FIGS. 1-5, may also be adjustable in the same manner.

In preferred embodiments, the adjustment feature comprises a pin hole 330 at the base of the paddle blade 312 where the paddle blade 312 joins the shaft 310, forming the throat 314. The adjustment feature further comprises at least two pin holes 332 near the end of the shaft 310 where the paddle blade 312 joins the shaft 310. Four (4) holes 332 are shown in FIG. 7, but the number of holes varies with the embodiment of paddle 300 to allow more or less adjustability of the length. Preferred embodiments have three (3) to five (5) holes 332, which provides a good balance between adjustability and other factors, such as the length of the opening at the base of the paddle blade 312. The adjustment feature also comprises a pin 334 (shown in FIG. 8) to secure the blade 312 to the shaft 310.

Figure 8:
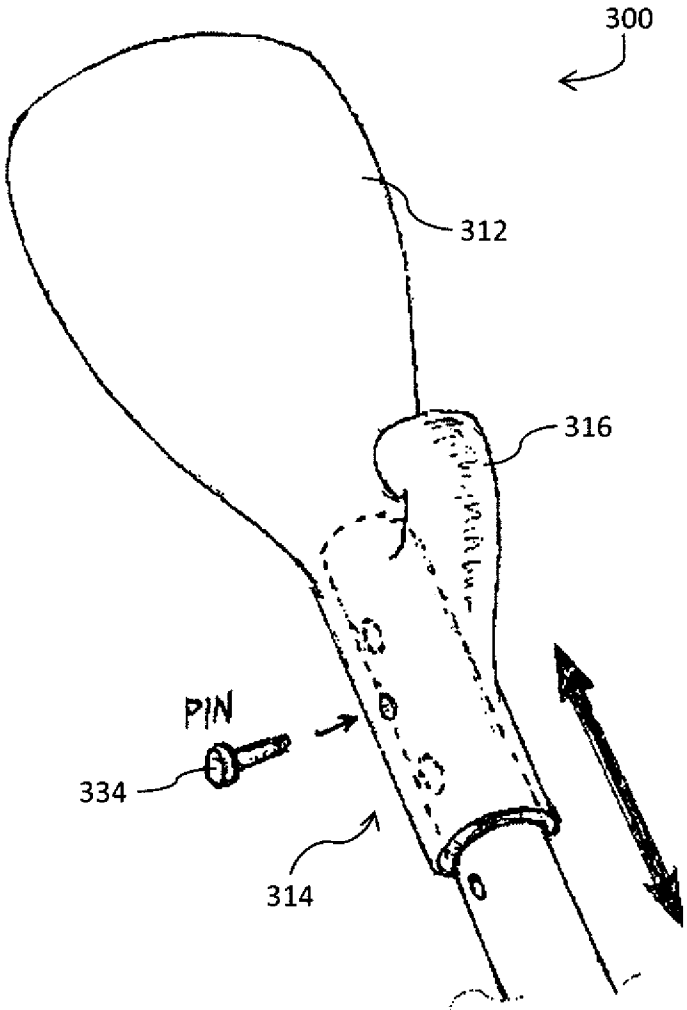
FIG. 8 illustrates the adjustment of the length of the hybrid paddle.

Referring now to FIG. 8, adjustment of the length of paddle 300 is made by aligning pin hole 330 with the desired pin hole 332, and inserting pin 334 through pin hole 330 and the chosen pin hole 332 in order to secure the blade 312 to the shaft 310 at e desired length of paddle 300.

In preferred embodiments of paddle 300, the above-described adjustment feature is present at both ends of the paddle 300, that is, both ends of shaft 310 have pin holes 332 and each paddle blade has a pin hole 330.

Some embodiments have more than one pin hole 330 on the blade 312, and some embodiments with multiple pin holes 330 on the blade 312 include multiple pins 334 in order to provide strength and redundancy in securing the blade 312 to the shaft 310.

Figure 9:
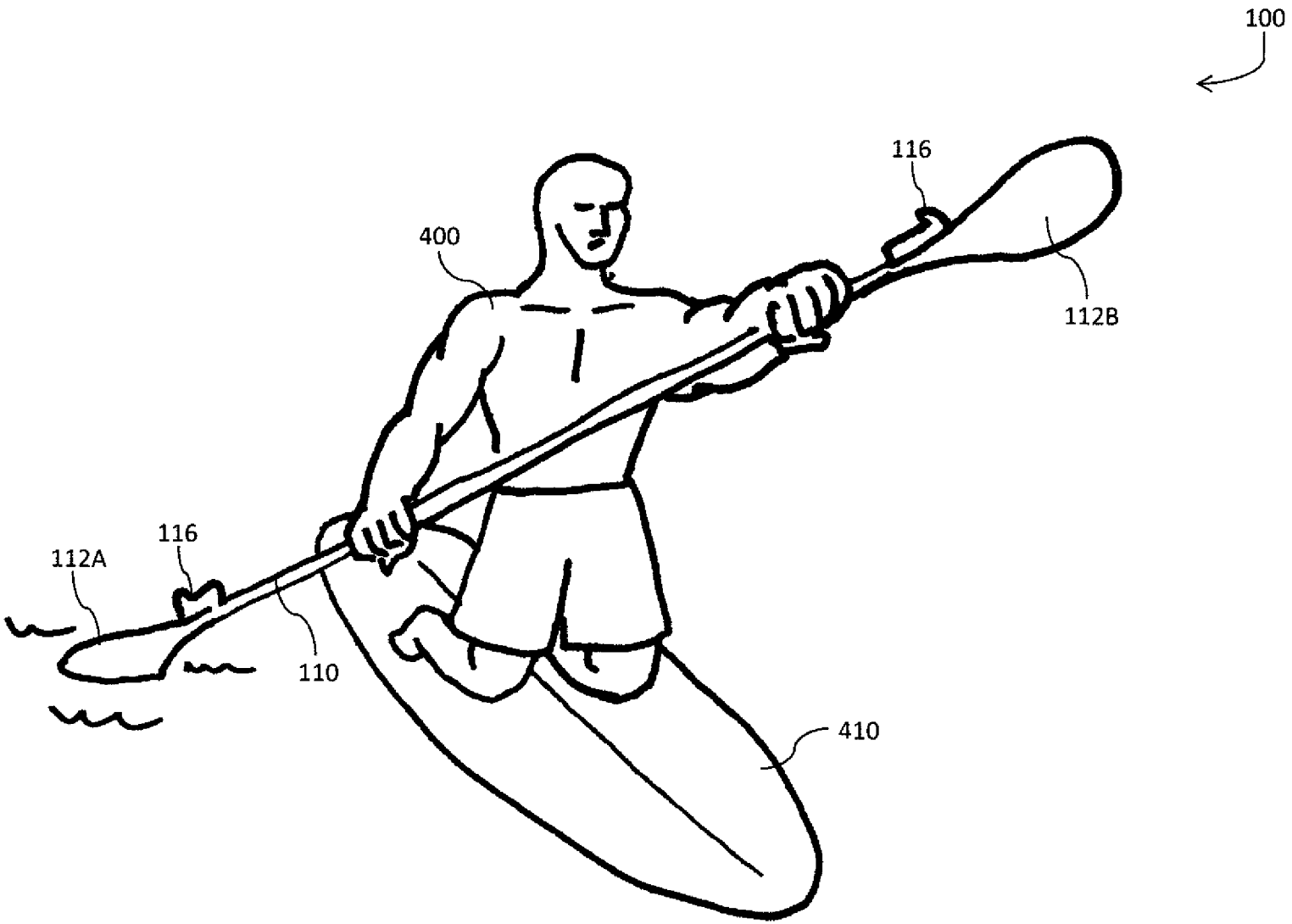
FIG. 9 illustrates the use of a hybrid paddle in a kneeling position.
Figure 10:
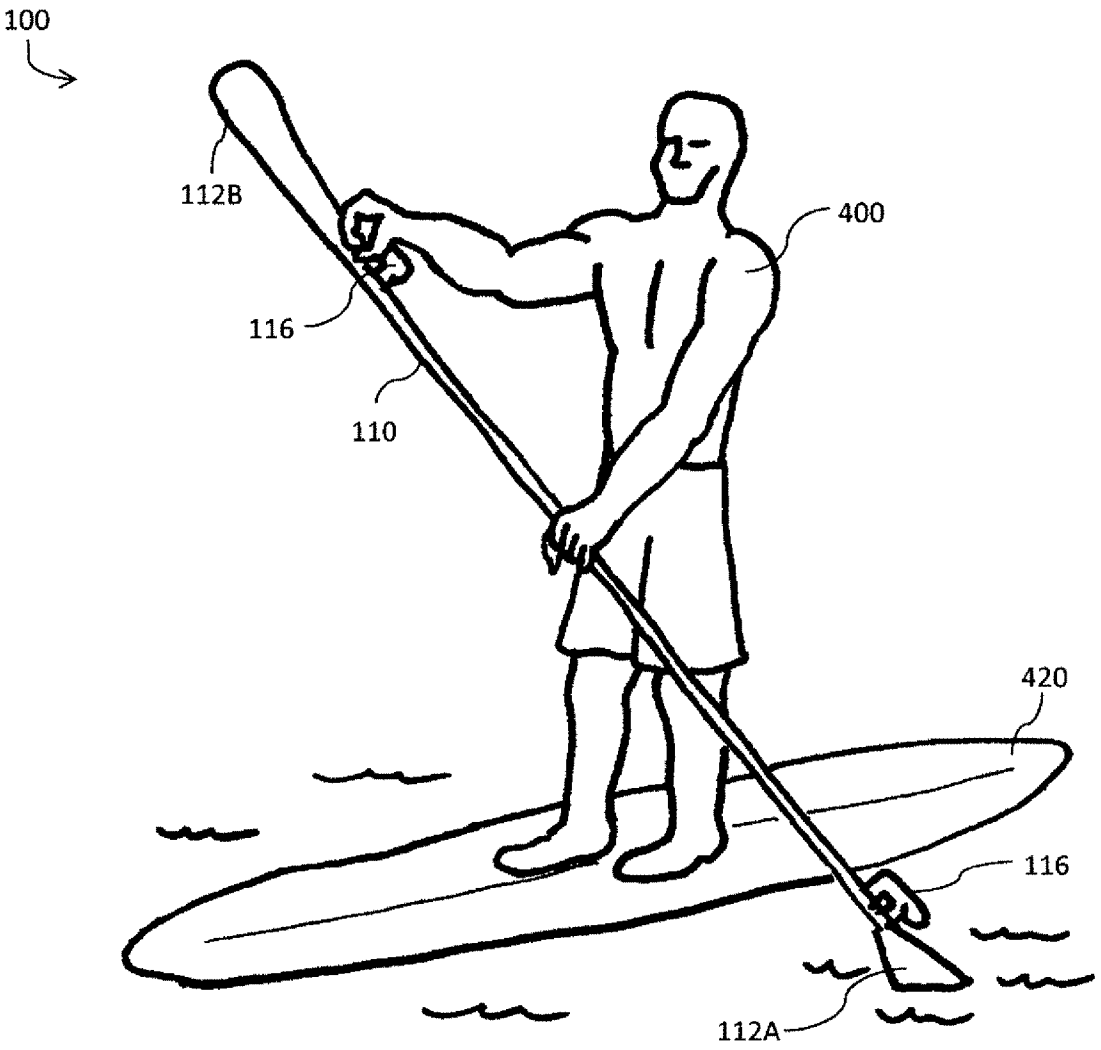
FIG. 10 illustrates the use of a hybrid paddle in a standing position.

FIGS. 9 and 10 depict a hybrid paddle 100 in use as both a stand-up paddle and a paddle for use in a kneeling or sitting position. Although paddle 100 is shown, the use of a hybrid paddle is substantially similar in each of the various embodiments of the hybrid paddle.

Referring now to FIG. 9, a hybrid paddle user 400 is shown kneeling on a paddleboard 410. In this position, the user 400 has grasped the shaft 110 of the paddle 100 with both hands, leaving the handles 116 unused. The user 400 is thus able to place one of the blades 112A ("the first blade") into the water and draw it across the water in order to propel himself and the paddleboard 410 across the water. While doing so, the other blade 112B is in the air, as depicted, so as not to interfere with the propulsion of the paddleboard.

The user 400 then places the other blade 112B into the water, raising the first blade 112A into the air, and draws the other blade 112B across the water in order to continue propelling himself and the paddleboard 410 across the water. The user thus alternates between one blade 112 and the other in propelling the paddleboard 410 forward.

This process is also used to propel other forms of watercraft, such as kayaks and canoes, in which the user 400 is in a kneeling or seated position.

Referring now to FIG. 10, the user 400 is depicted in a standing position on a stand-up paddleboard 420. In this position the user grabs a handle 116 by the grip 118 with one hand, and the shaft 110 of the paddle 100 by the other hand. The blade 112B next to the handle 116 grabbed by the user 400 remains out of the water for the duration of use in the standing position. The other handle 116 is not used, although it provides the user 400 with the option to grasp the paddle 100 by either end—whichever the user 400 finds most convenient.

In use, the blade 112A opposite the handle 116 that the user 400 is grasping is placed in the water and drawn across the water in order to propel the paddleboard 420. After drawing the blade 112A across the water, the user 400 lifts the blade 112A, moves it forward, inserts it into the water again, and draws it across the water, repeating the process in order to continue propulsion of the user and the paddleboard 420. In doing so, the user 400 may change the side of the paddleboard 420 at which the blade 112A is placed in the water, allowing for a similar amount of propulsion from both sides of the paddleboard 420 over time, resulting in a straighter course of travel.

A user 400 on a paddleboard 420 is thus able to alternate between use of the paddle 100 from a kneeling position and a standing position, as shown in FIGS. 9 and 10, at the user's convenience.

Figure 11:
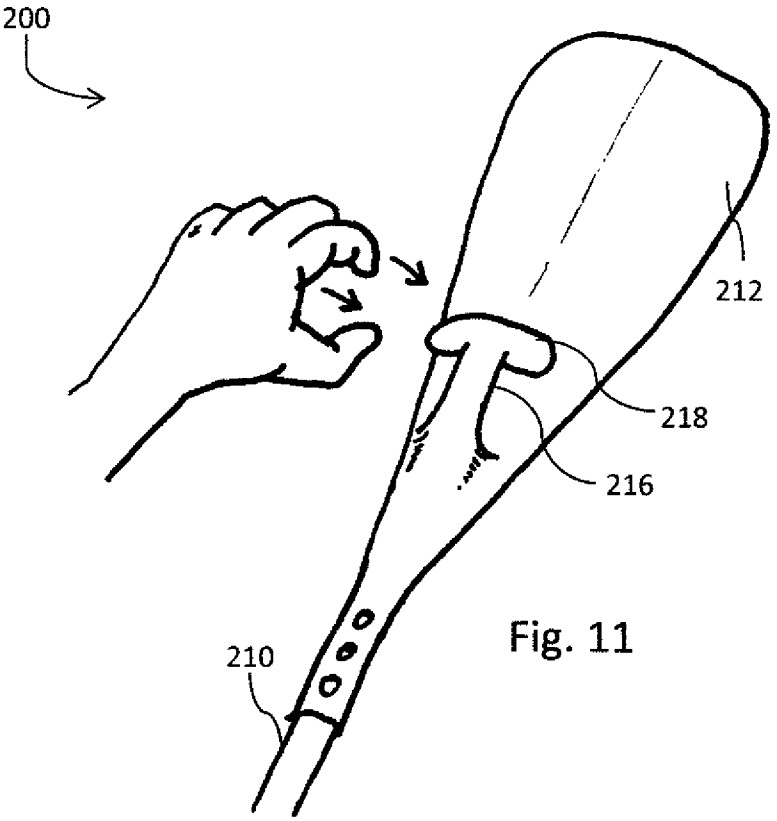
FIG. 11 illustrates a manner of grasping a handle on a hybrid paddle.

Referring now to FIG. 11, the manner of grasping the handle 216 of a hybrid paddle 200 is illustrated. The same method is used for grasping a mountable, non-integral handle 116 of a hybrid paddle 100. The hand is placed around the grip 218 of the handle 116.

Figure 12:
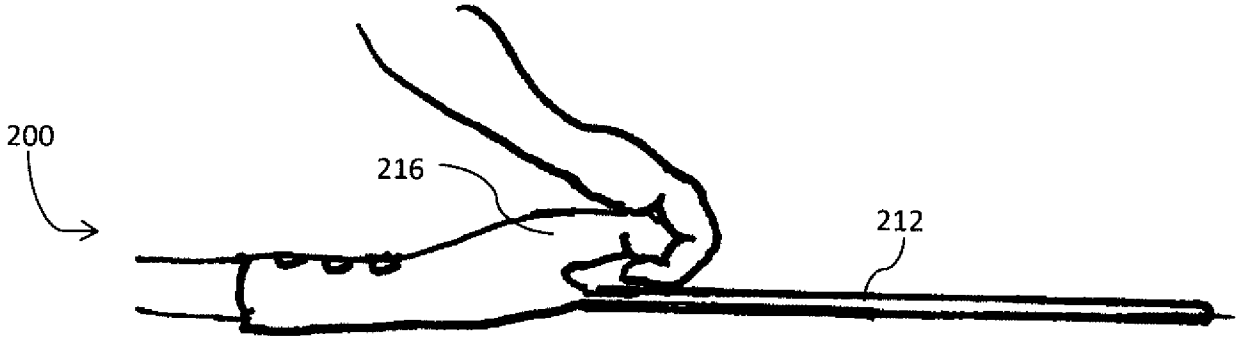
FIG. 12 illustrates a user's hand grasping a handle on a hybrid paddle.

As seen in FIG. 12, the offset of the grip 218 from the blade 212 allows the hand to be placed around the grip 218 without colliding with the blade 212.

Figure 13:
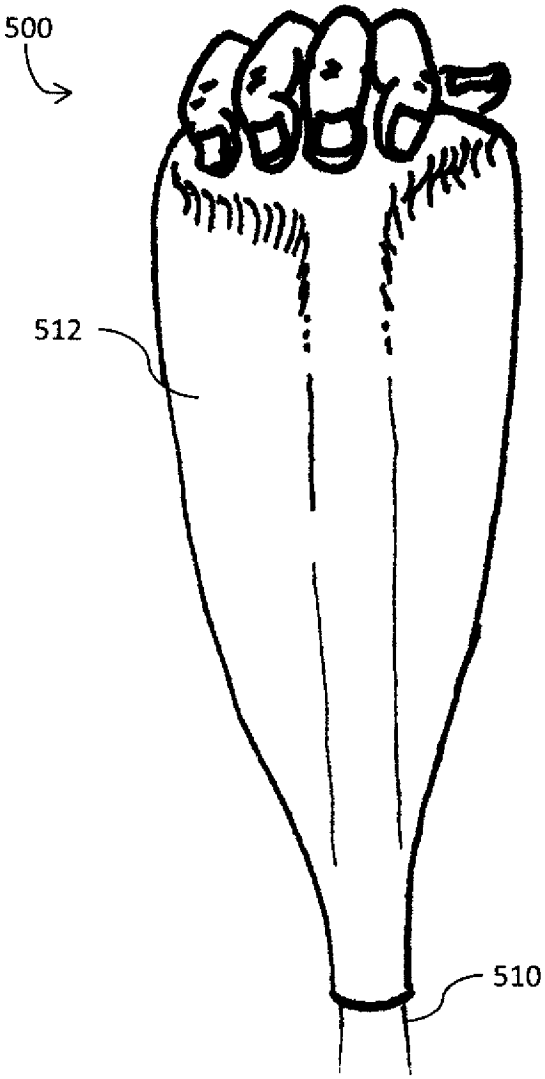
FIG. 13 illustrates an alternative embodiment of a hybrid paddle having a blade configured for use as a paddle

Referring now to FIG. 13, an alternate embodiment of a hybrid paddle is shown and generally designated 500. Instead of having a separate handle, the top of the blade 512 of paddle 500 is shaped so that the user can conveniently and comfortable grasp the top of the blade 512 and use it as a handle. By using the blade 512 as a handle, the length of the paddle 500 can be reduced, resulting in a more comfort for some users while using the paddle in a seated position in a kayak.

Figure 14:
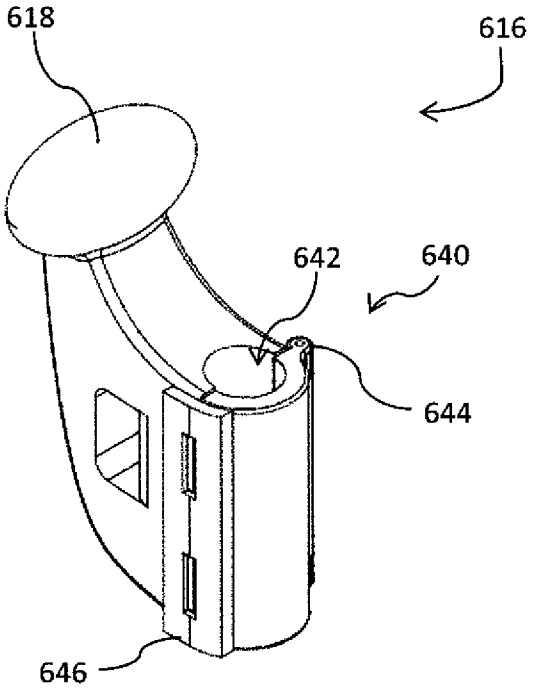
FIG. 14 illustrates an alternative embodiment of a handle for mounting on a paddle.

Referring now to FIG. 14, an alternate embodiment of a mountable handle is shown and generally designated 616. Handle 616 comprises a grip 618 attached to a mounting structure 640 comprising a cylindrical aperture 642 sized to fit securely around the throat 114 of a paddle 100. A hinge 644 and a locking member 646 allow the mounting structure 640 to be secured in the closed configuration shown in FIG. 14, or to be opened for removal from or attachment to a paddle 100. The grip 618 extends away from the mounting structure 640 so that, when the handle 616 is attached to a paddle 100, the grip 618 is sufficiently offset from the paddle 100 so that the user's hand does not collide (i.e. contact) with the paddle 100, and more specifically the blade 112 of the paddle 100.

Figure 15:
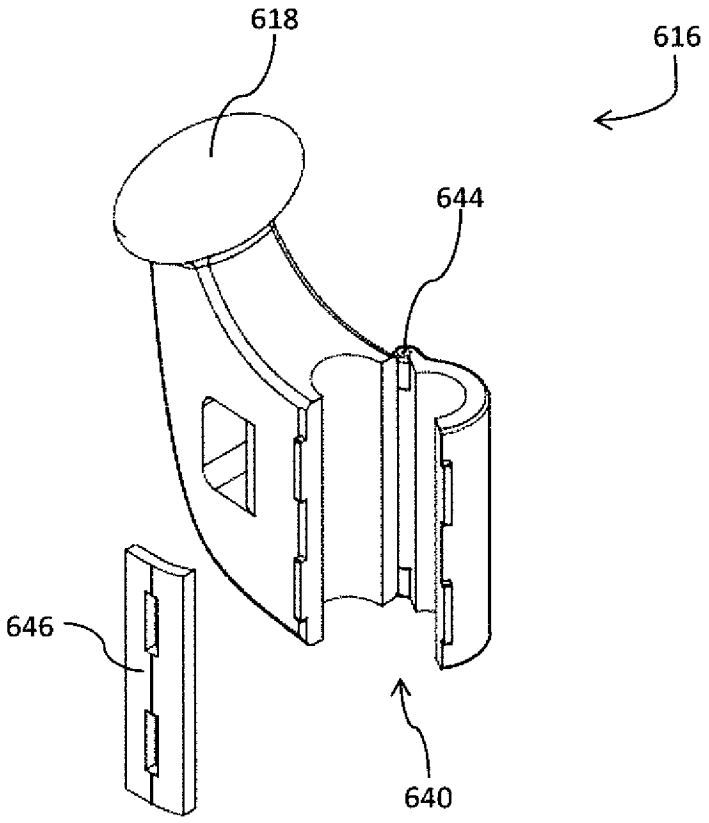
FIG. 15 illustrates the handle of FIG. 14 in an open configuration to enable mounting and removal.

Referring now to FIG. 15, by removing the locking member 646, the mounting structure 640 may be placed in the open configuration shown. When the handle 616 is secured to a paddle 100, placing the mounting structure 640 into the open configuration allows for removal of the handle 616 from the paddle 100. Placing the mounting structure 640 into the open configuration also allows the handle 616 to be placed onto a paddle 100, after which the mounting structure 640 may be placed into the closed configuration in order to secure it to the paddle 100.

While the invention has been described here in terms one or more preferred embodiments, it will be apparent to those skilled in the art that various changes and modifications can be made to those embodiments, and other embodiments altogether can be used to carry out the invention, without departing from the scope and spirit of the invention.

What is claimed is:

1. A handle attachment for a paddle, comprising:

a shaft;

a handle comprising a grip; and a mounting structure configured to removably attach the handle to the shaft by receiving the shaft inserted into an aperture of the mounting structure up to a depth, wherein the handle is at a throat of the paddle between the aperture and the depth and is integral with a blade of the paddle and the mounting structure.

2. The handle for attachment to a paddle as recited in claim 1, wherein the handle is configured so that the grip is offset from the paddle when the handle is attached to the paddle, the offset being sufficient to avoid collision of a hand grasping the grip with the paddle.

3. The handle attachment for a paddle as recited in claim 1, wherein the aperture is cylindrical.

4. The handle for a paddle as recited in claim 1, wherein the mounting structure comprises a mounting structure pinhole.

5. The handle for a paddle as recited in claim 4, wherein the pinhole is configured to align with a shaft pinhole along the shaft.

6. The handle for a paddle as recited in claim 5, wherein a pin is configured to pass through the mounting structure pinhole and the shaft pinhole.

7. A hybrid paddle, comprising:

a shaft between a first end and a second end;

a first blade at the first end;

a first throat comprising a first junction between the first blade and the shaft;

a first handle at the first throat;

a second blade at the second end;

a second throat comprising a second junction between the second blade and the shaft, wherein the second throat is configured to receive the shaft inserted into an aperture of the second throat up to a depth; and a second handle at the second throat and integral with the second blade at the second throat between the aperture and the depth.

8. The hybrid paddle as recited in claim 7, wherein the first handle comprises a first grip configured for use in stand-up paddleboarding, and wherein the second handle comprises a second grip configured for use in stand-up paddleboarding.

9. The hybrid paddle as recited in claim 8, wherein the first grip is sufficiently offset from the first blade so that a user may grip the first handle without colliding with the first blade.

10. The hybrid paddle as recited in claim 8, wherein the shaft has a predetermined length configured to facilitate use of the hybrid paddle in kayaking.

11. The hybrid paddle as recited in claim 10, further comprising means for adjusting a length of the hybrid paddle.

12. The hybrid paddle as recited in claim 11, wherein the means for adjusting length of the hybrid paddle comprises:

a first blade pin hole at the base of the first blade;

at least two first end pin holes at the first end of the shaft; and a pin configured to pass through the first blade pin hole and one of the at least two first end pin holes in order to secure the first blade to the shaft.

13. The hybrid paddle as recited in claim 7, wherein the first handle is integral with the first blade.

14. The hybrid paddle as recited in claim 7, wherein the first blade is topologically simply connected, and wherein the second blade is topologically simply connected.

15. A hybrid paddle, comprising:

a paddle, comprising a shaft between a first end and a second end;

a first blade at the first end;

a first throat comprising a first junction between the first blade and the shaft;

a second blade at the second end; and a second throat comprising a second junction between the second blade and the shaft, wherein the second throat is configured to receive the shaft inserted into an aperture of the second throat up to a depth, a first handle comprising a first grip and configured to removably attach to the paddle at the first throat, and a second handle comprising a second grip and configured to removably attach to the paddle at the second throat, and wherein the second handle is integral with the second blade at the second throat between the aperture and the depth.

16. The hybrid paddle as recited in claim 15, wherein the first handle is configured so that the first grip of the first handle is offset from the paddle when the first handle is attached to the paddle, the offset being sufficient to avoid collision of a hand grasping the grip of the first handle with the paddle.

17. The hybrid paddle as recited in claim 15, wherein the aperture is cylindrical.

* * * * *